United States Patent [19]

Svensson

[11] Patent Number: 4,543,880

[45] Date of Patent: Oct. 1, 1985

[54] METHOD AND A DEVICE FOR EXPELLING LIQUID BY SQUEEZING OF MASSES HAVING GREAT LIQUID CONTENT

[76] Inventor: Rolf Svensson, Skymningsvägen 16, S-198 00 Bålsta, Sweden

[21] Appl. No.: 554,738

[22] Filed: Nov. 23, 1983

[30] Foreign Application Priority Data

Nov. 25, 1982 [SE] Sweden ..... 8206727

[51] Int. Cl.[4] ..... B30B 9/24

[52] U.S. Cl. ..... 100/37; 100/118; 100/153; 210/386; 210/400

[58] Field of Search ..... 100/37, 118, 119, 120, 100/121, 151, 152, 153, 154; 162/301, 203; 210/400, 401, 386

[56] References Cited

U.S. PATENT DOCUMENTS

| | | | |
|---|---|---|---|
| 3,056,719 | 10/1962 | Webster | 162/203 |
| 3,459,123 | 8/1969 | Begiebing | 100/118 |
| 4,303,523 | 12/1981 | Ruppnig | 210/386 |
| 4,348,290 | 9/1982 | Schipper | 210/400 X |

FOREIGN PATENT DOCUMENTS

| | | |
|---|---|---|
| 1052152 | 4/1979 | Canada . |
| 0013548 | 12/1979 | European Pat. Off. . |
| 2422945 | 5/1974 | Fed. Rep. of Germany . |
| 2551127 | 11/1975 | Fed. Rep. of Germany . |
| 75040758 | 4/1975 | Sweden . |
| 1512960 | 6/1978 | United Kingdom . |

*Primary Examiner*—Peter Feldman

*Attorney, Agent, or Firm*—Pollock, Vande Sande & Priddy

[57] ABSTRACT

A method and device is disclosed for expelling liquid by squeezing of masses, having great liquid content and particularly highly re-absorbing masses, most particularly peat, said method comprising the steps of squeezing the mass between endless filter cloths running in a winding path around a plurality of press rollers acting on said filter cloths only and having progressively decreasing diameter and subjecting the mass to a more and more increasing squeeze pressure. According to the invention the filter cloths run from one press roller directly onto the subsequent roller in order to make the mass between said cloths subject to an uninterruptedly increasing squeeze pressure.

8 Claims, 1 Drawing Figure

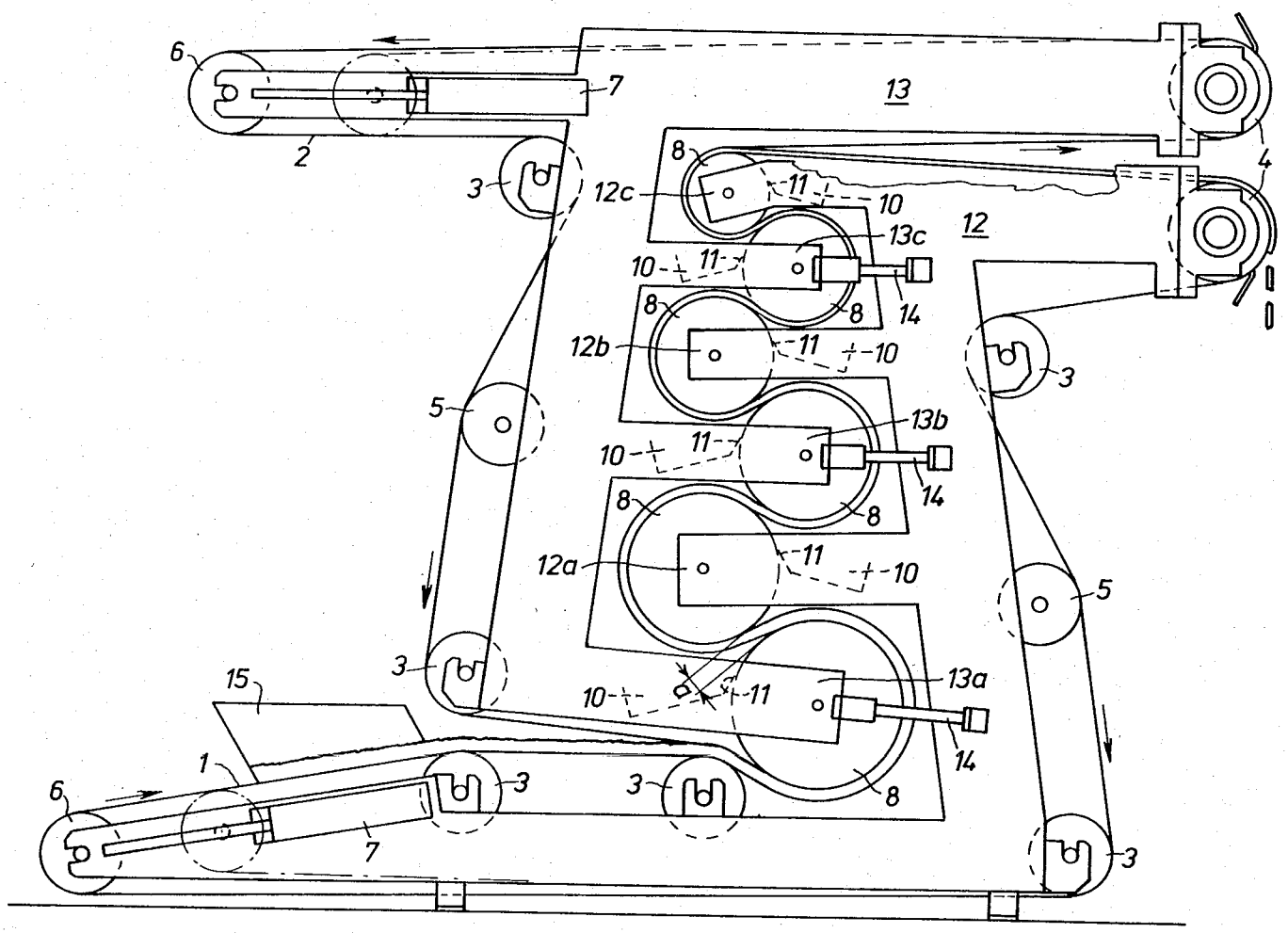
1
2
3
4
5
6
7
8
10
11
12
12a
12b
12c
13
13a
13b
13c
14
15

METHOD AND A DEVICE FOR EXPELLING LIQUID BY SQUEEZING OF MASSES HAVING GREAT LIQUID CONTENT

The present invention refers to a method and a device for expelling liquid by squeezing of masses having great liquid content and particularly highly re-absorbing masses, most particularly peat, in which squeezing the mass included between endless filter cloths is carried in a winding path around a plurality of press rollers acting on said filter cloths only and not on each other, said press rollers having progressively decreasing diameter, and subjecting the mass to a more and more increasing squeeze pressure.

For removing liquid from masses having great liquid content it is common to subject the masses to a squeezing in a filter cloth press. In such a press the material is carried between a pair of filter cloth webs running substantially parallel to each other within the squeezing zone and in a winding path over idle and guide rollers. Even though the path has a winding shape, it is arranged substantially in a horizontal direction. As examples of such squeezing methods and devices it can be mentioned DOS Nos. 2 422 945 and 2 551 127, which both disclose squeezing of wet masses between filter cloths and of which the first-mentioned particularly detailed discloses the problems met in these connections as well as various known suggestions for eliminating said problems. In both specifications, the cloths and the masses are carried, however, through nips between pairs of mutually cooperating rollers, in which high transient line pressures are applied on the masses, which is particularly unsuitable for masses having poor or no fiber bonds at all, such as peat.

Furthermore, in SE-B No. 7504075-8 it has furthermore been disclosed the application of an additional pressure onto filter cloths by means of an exteriorly located press web, but the arrangement for the rest do not provide for the achievement of any substantially improved squeezing action as far as e.g. peat is concerned. Finally, in EP No. 0013548 it has been disclosed as belonging to prior art a squeezing device having a plurality of rollers mounted in a row after each other and having progressively decreasing diameter, over which rollers filter cloths run in a winding path. In said arrangement the rollers are mutually spaced in such a way that the pressure on the material to be squeezed has time to be substantially relieved when passing over from one roller to the subsequent one.

With the present embodiments the development of the filter cloth presses has been substantially finished and it is no longer possible to obtain any substantial improvement of the water-eliminating capability of the presses. Moreover, it is no use to carry the squeezed material through the same or a similar filter cloth press again for providing a further liquid expulsion. A main reason thereto resides in the fact that in the squeezed material there are present a vast number of channels, through which the liquid already has been expelled and therefore a repeated similar squeezing in the filter cloth press will give no further liquid expulsion worth mentioning. Another important fact is that many of those masses having great liquid content and particularly waste-water sludge and peat have a strong inherent spring-back action and hence re-absorbing tendency at the same time as the pair of filter cloths after finished squeezing at each roller maintains a great amount of liquid which therefore easily will be re-absorbed into the mass. This last-mentioned fact thus has hitherto put a clear limit to the extent of liquid expulsion which can be achieved by means of known filter cloth presses.

The main object of the present invention now is to suggest a method and a device for providing a liquid expulsion of still higher efficiency and the invention thereby is based on the idea that first of all the re-absorbing of liquid maintained in the filter cloths is to be prevented. According to the present invention this is achieved by means of a method which is substantially distinguished in that the mass disposed between the filter cloths is subjected to an uninterruptedly increasing squeeze pressure by carrying the filter cloths from one press roller directly onto the subsequent roller.

Another object of the invention is to provide a device for carrying out said method, which device comprises two endless filter cloths between which the mass from which liquid is to be expelled is disposed, a squeeze zone through which said filter cloths are running substantially in parallel relationship, a plurality of press rollers acting on said filter cloths only and not on each other, said rollers having progressively decreasing diameter and a winding path for said running endless filter cloths through said squeeze zone and formed by said plurality of press rollers. According to the invention said device is substantially distinguished in that the press rollers are mounted directly adjacent and vertically above each other in such a way that the filter cloths from one press roller are running directly onto the subsequent roller in order to make the mass between the filter cloths subject to an uninterruptedly increasing squeeze pressure, the first and largest roller as seen in the direction of travel of said cloth being located lowermost and the filter cloths approaching said roller at the lower half thereof.

With the method and device according to the present invention a much more efficient liquid expulsion can be obtained by squeezing masses having great liquid content so as to obtain essentially increased dry content percentages, owing to which one e.g. can make peat usable as fuel for furnaces without extensive further treatments.

By way of example the invention will be further described below with reference to the enclosed drawing which is a diagrammatic side elevational view of a device according to the invention for carrying out the method.

As is evident from the drawing, a device according to the invention comprises two filter cloths 1, 2 known per se and each carried in a closed loop and each running along a path over idle rollers 3, drive roller 4, guide roller 5 and tensioning roller 6. Each tensioning roller 6 is provided with a pair of suitable tensioning means 7 for stretching the filter cloths 1, 2 in order to maintain a desired tensioning thereof and said tensioning means 7 might consist of known means such as hydraulic pressure cylinders.

Within the zone of the machine or press, in which the squeezing is to be carried out, the two filter cloths with the mass included therebetween is carried in a winding path over a plurality of press or squeeze rollers 8. According to the invention, said press rollers 8 are arranged vertically above each other and have progressively decreasing diameter from below and upwardly. The rollers 8 are mutually slightly laterally off-set in horizontal direction such that the filter cloths 1, 2 with the mass included therebetween, from which mass liquid is to be expelled, enclose each roller 8 encircle each roller 8 over more than half the periphery. Furthermore, the device according to the invention is made such that the filter cloths 1, 2 reach the first, largest press roller 8, which thus is lowermost, at a position on the lower half of the circumference thereof. Moreover the rollers 8 are arranged with a minimum mutual spacing a substantially equal to the thickness of the layer of mass between the two filter cloths when they leave the preceeding roller 8 plus the thickness of the filter cloths 1, 2. Owing thereto the squeeze pressure will be uninterruptedly maintained without any free transportation distances between the rollers, along which distances the squeeze pressure will be more or less relieved and the mass between the filter cloths is given an opportunity to expand and thereby re-absorb liquid maintained in the filter cloths. At each press roller 8 is arranged at the side of said roller which is not encircled by the filter cloths a liquid collection trough 10 with a wiping means 11 engaging the roller.

Dimensioning to the squeezing efficiency is the final pressure and the time of residence for the mass in the squeezing zone. For this reason there is chosen a tensioning force of the filter cloths 1, 2 lying very close to the maximum allowable tension, i.e. the tensile strength of the filter cloth material. Since joints in filter cloths hitherto mostly have had lower tensile strength than the very filter cloth the device according to the present invention therefore has been designed to operate with endless filter cloths 1, 2. In order to provide for an exchange of the filter cloths, which must be carried out laterally out of and into the squeezing zone, respectively, the device has been designed with press end walls of particular shape. More closely, each end wall of the device is made, such as is evident from the drawing, into halfs 12, 13 and the press rollers 8 are supported alternately from one half end wall or the other, 12, 13, respectively. From the half end wall 12 thus extend support arms 12*a*, 12*b* and 12*c* up to the second, fourth and last press roller 8 within the press zone, while from the half end wall 13 in a similar manner extend support arms 13*a*, 13*b* and 13*c* for supporting the first, third and last but one press roller 8. Between the support arms 12*a*, 12*b* and 12*c* and 13*a*, 13*b* and 13*c*, respectively, there are free spaces which provide for a free removal laterally of the endless filter cloths 1, 2.

The half end wall 12 is adapted to rest on a base, floor or the like, not further illustrated, while the other half end wall 13 is horizontally movably supported and guided in a manner not further illustrated relative the first half end wall 12 and is substantially horizontally adjustable relative the latter by means of suitable and preferably mechanical adjustment means such as a bolt-and-nut connection 14 between the half end wall 12 and the respective support arm 13*a*, 13*b* and 13*c*. Said means 14 have to be made easily removable in order to provide for an exchange of the endless filter cloths 1, 2.

For carrying out an exchange of the filter cloths it is also required the intermediation of auxiliar equipment which preferably can include an additional pair of half end walls and roller-like means, not further illustrated and adapted to freely support from the base during exchange of the filter cloths the half end walls 12, 13 of one side while substantially maintaining the mutual orientation.

The method according to the invention now is to be described with reference to the device as illustrated in the drawing and described in detail above. The mass which has a very great content of liquid and which is to be treated and which might be constituted by sewer sludge or peat is most often subject to a preparatory treatment in the form of a pre-removal of liquid which transfers the mass to the form a mat. Said mat then preferably is carried to a shreader on one hand to provide for an adaptation of the speed of the supply of material or mass to the filter cloth press and on the other for providing new liquid removal channels within the mass.

The mass thus preparatory treated if desired is supplied to a squeeze zone by letting same fall down into a feed box 15 of the device illustrated in the drawing. The bottom of said feed box 15 is constituted by one of the filter cloths 1 which carries said mass as charged out of the feed box 15. The upper filter cloth 2 then adjoins from above wedge-like to the mass present on the first, lower filter cloth 1 and together said filter cloths 1, 2 with the mass lying therebetween are carried to a squeeze zone. According to the invention said squeeze zone is adapted to provide an uninterrupted and progressively increased squeeze pressure on the mass between the filter cloths and this is thus obtained by carrying the filter cloths 1, 2 with the mass in a winding path around a plurality, in the present case six press rollers 8 arranged vertically above each other and having progressively decreasing diameter. In doing so, the filter cloths 1, 2 firstly are directed to the first lowermost and largest press roller 8 at a position at the lower half of the periphery thereof and then run around said roller over more than half the circumference thereof before the filter cloths directly without interposed transport distance are carried onto the subsequent smaller press roller 8, which they for the rest also reach at a position at the lower half of the periphery, and then said cloths pass over more than half the circumference of also this roller 8 and further directly onto the next press roller 8 with still slightly smaller diameter etc until each press roller 8 has been passed and the mass between the filter cloths 1, 2 been subjected to greatest possible squeezing action and hence maximum liquid expulsion. After finished squeezing the mass is suitably discharged and might e.g. be let to fall down onto a conveyor for being transferred to further treatment, if desired.

I claim:

1. A device for expelling liquid from a mass having an absorbed liquid content, said device comprising:

two endless filter cloths arranged to travel substantially in parallel through a squeeze zone;

means for disposing the mass from which liquid is to be expelled between said filter cloths ahead of said squeeze zone; and, a plurality of press rollers for successively acting on said filter cloths only and not on each other in said squeeze zone and for providing a winding path of travel for said filter cloths through said squeeze zone, the first of said rollers being the largest and said rollers progressively decreasing in diameter in the direction of travel of said filter cloths;

said rollers being laterally offset relative to each other and positioned adjacent to each other such that said filter cloths with the mass therebetween encircle each of said rollers over more than half the periphery thereof and run directly between successive rollers without interposed transport distance so as to provide an uninterrupted and progressively increasing squeeze pressure on the mass between said filter cloths.

2. The device according to claim 1 in which said press rollers are mounted with a radial spacing between adjacent rollers substantially equal to the thickness of the mass between said filter cloths plus the thickness of said filter cloths.

3. The device according to claim 1 in which one end of said press rollers are mounted for rotation on an end wall comprised of two half end walls, said half end walls having support arms each supporting a press roller and said press rollers being supported alternately from one of said half end walls and the other of said half end walls respectively so as to provide free spaces between said support arms for removing said filter cloths axially from said rollers and laterally through said end wall.

4. The device according to claim 3 in which at least a first press roller and a third press roller are supported on corresponding support arms of one of said half end walls and at least a second press roller is supported on a support arm of the other of said half end walls.

5. The device according to claim 3 in which a first press roller, a third press roller and a fifth press roller are supported on corresponding support arms of one of said half end walls and a second press roller, a fourth press roller and a sixth press roller are supported on corresponding arms of the other of said half end walls.

6. The device according to claim 1 comprising at least three press rollers and in which said filter cloths with the mass included therebetween encircle over more than half the periphery of each of said three press rollers.

7. The device of claim 1 comprising six press rollers and in which said filter cloths with said mass therebetween encircle over half the periphery of each of said six press rollers.

8. A method for expelling liquid from a mass having an absorbed liquid content, said method comprising the steps of:

disposing the mass from which liquid is to be expelled between two endless filter cloths ahead of a squeeze zone;

causing said filter cloths to travel substantially in parallel through said squeeze zone with said mass therebetween; and, squeezing said mass between said endless filter cloths by running said filter cloths in a winding path around a plurality of press rollers successively acting on said filter cloths only and not on each other in said squeeze zone;

the first of said rollers in said squeeze zone being the largest and said rollers progressively decreasing in diameter in the direction of travel of said filter cloths through said squeeze zone, and said rollers being laterally offset relative to each other and positioned adjacent to each other such that said filter cloths with said mass therebetween encircle each of said rollers over more than half the periphery thereof and run directly between successive rollers without interposed transport distance so as to provide an uninterrupted and progressively increasing squeeze pressure on the mass between said filter cloths.

* * * * *